US007075250B2

(12) United States Patent
Colwell

(10) Patent No.: US 7,075,250 B2
(45) Date of Patent: Jul. 11, 2006

(54) THREE-COMPONENT PROTECTIVE HEAD GEAR POWERED BY A RECHARGEABLE BATTERY

(75) Inventor: Walter R. Colwell, Las Vegas, NV (US)

(73) Assignee: SETO Holdings, Inc., Briarcliff Manor, NY (US)

( * ) Notice: Subject to any disclaimer, the term of this patent is extended or adjusted under 35 U.S.C. 154(b) by 0 days.

(21) Appl. No.: 10/725,766

(22) Filed: Dec. 2, 2003

(65) Prior Publication Data

US 2005/0116664 A1 Jun. 2, 2005

(51) Int. Cl.
*G05F 1/00* (2006.01)

(52) U.S. Cl. ..... 315/291; 315/200 A; 315/185 R; 315/216; 362/106; 362/227

(58) Field of Classification Search ..... 315/291, 315/312, 185 R, 224, 200 A, 216, 241 S, 315/169.3; 362/105, 106, 227, 800
See application file for complete search history.

(56) References Cited

U.S. PATENT DOCUMENTS 5,040,099 A * 8/1991 Harris ..... 362/473
5,327,587 A * 7/1994 Hurwitz ..... 2/422
5,329,637 A * 7/1994 Walker ..... 2/5
5,357,409 A * 10/1994 Glatt ..... 362/105
5,426,792 A * 6/1995 Murasko ..... 2/422
5,479,325 A * 12/1995 Chien ..... 362/105
5,485,358 A * 1/1996 Chien ..... 362/106
5,544,027 A * 8/1996 Orsano ..... 362/105
5,564,128 A * 10/1996 Richardson ..... 2/422
5,570,946 A * 11/1996 Chien ..... 362/84
5,743,621 A * 4/1998 Mantha et al. ..... 362/105
5,758,947 A * 6/1998 Glatt ..... 362/105
5,871,271 A * 2/1999 Chien ..... 362/106
6,007,213 A * 12/1999 Baumgartner ..... 362/106
6,009,563 A * 1/2000 Swanson et al. ..... 2/425
6,113,244 A * 9/2000 Baumgartner ..... 362/106
6,244,721 B1 * 6/2001 Rodriguez et al. ..... 362/106
6,328,454 B1 * 12/2001 Davis ..... 362/105
6,340,234 B1 * 1/2002 Brown, Jr. ..... 362/105
6,400,101 B1 * 6/2002 Biebl et al. ..... 315/291
6,464,369 B1 * 10/2002 Vega et al. ..... 362/106
6,497,493 B1 * 12/2002 Theisen ..... 362/105
6,733,150 B1 * 5/2004 Hanley ..... 362/106

* cited by examiner

*Primary Examiner*—Haissa Philogene
(74) *Attorney, Agent, or Firm*—Willie Krawitz; Stuart W. Knight

(57) ABSTRACT

A three-component, protective headgear or helmet is provided with a battery-powered LED head lamp, which may be used by construction workers, search and rescue persons, cyclists, police, fireman, and the like. The battery may be replaceable or rechargeable and has long-term, uniform output characteristics driven by unique circuitry.

10 Claims, 4 Drawing Sheets

THREE-COMPONENT PROTECTIVE HEAD GEAR POWERED BY A RECHARGEABLE BATTERY

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION (1) Field of the Invention

This application relates to a new and improved headgear, and more specifically to a headgear or helmet providing a lighting display for use by cyclists, construction and underground workers, search and rescue persons, emergency medical workers, firemen, police, meter readers, and so forth. The lighting display may be used to define a forward pathway or to illuminate objects, or to rearwardly signal a wearer's presence.

(2) Description of Related Art Including Information Disclosed Under 37 C.F.R. 1.97 and 1.98

Various types of protective helmets providing lighting displays are known in the prior art, and typical types of these helmets are described in U.S. Pat. Nos. 5,040,099; 5,327,587; 5,329,637; 5,357,409; 5,426,792; 5,479,325; 5,544.027; 5,485,358; 5,564,128; 5,570,946; 5,743,621; 5,758,947; 5,871,271; 6,007,213; 6,009,563; 6,113,244; 6,244,721; 6,328,454; 6,340,224; 6,464,369; and, 6,497,493.

However, none of the headgear in these patents disclose a battery powered circuit for an LED array that produces a long term, uniform illumination while providing a useful device for its intended purpose. The headgear structure of this invention may be a single, or a multi-component type, such as two or three.

BRIEF SUMMARY OF THE INVENTION

A new and improved headgear is provided with a lighting display comprising an LED array powered by built-in, rechargeable batteries through a unique circuit which enables a long-term, suitably constant output.

DETAILED DESCRIPTION OF THE INVENTION

Figure 1:
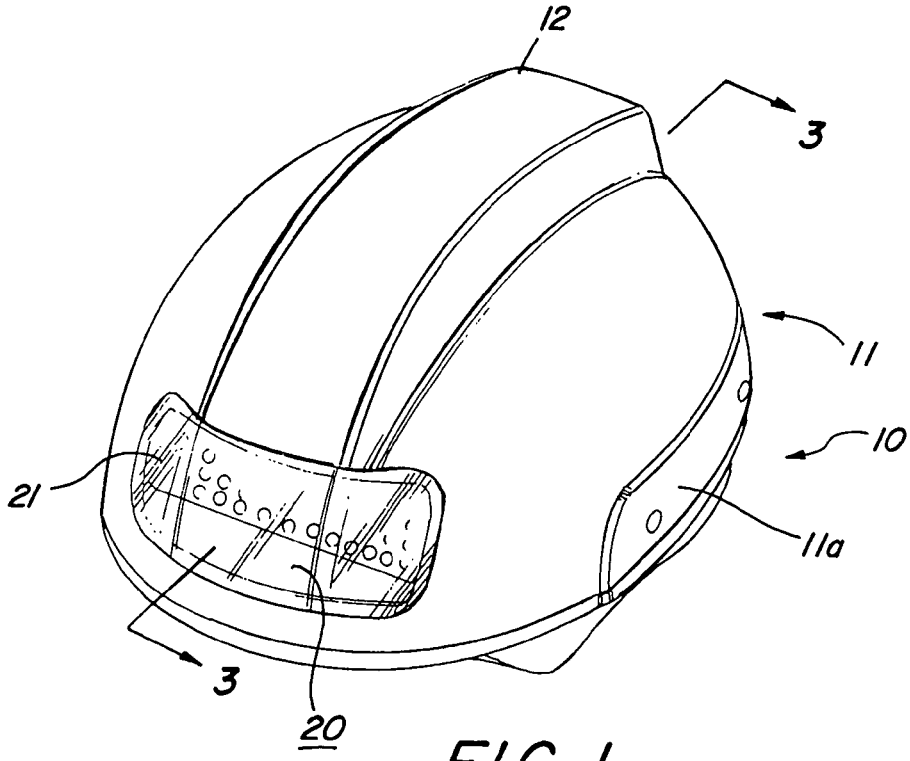
FIG. 1 is an upper perspective view of the assembled headgear of this invention.
Figure 3:
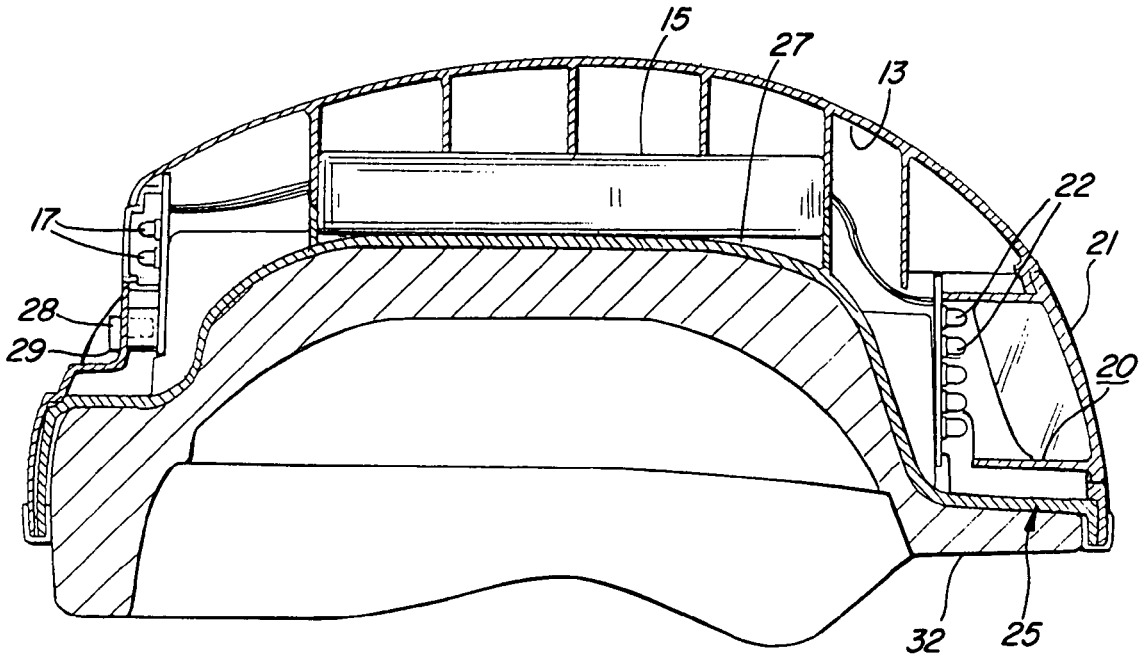
FIG. 3 is a sectional side elevation view of the headgear taken along lines 3—3 of FIG. 1.
Figure 2:
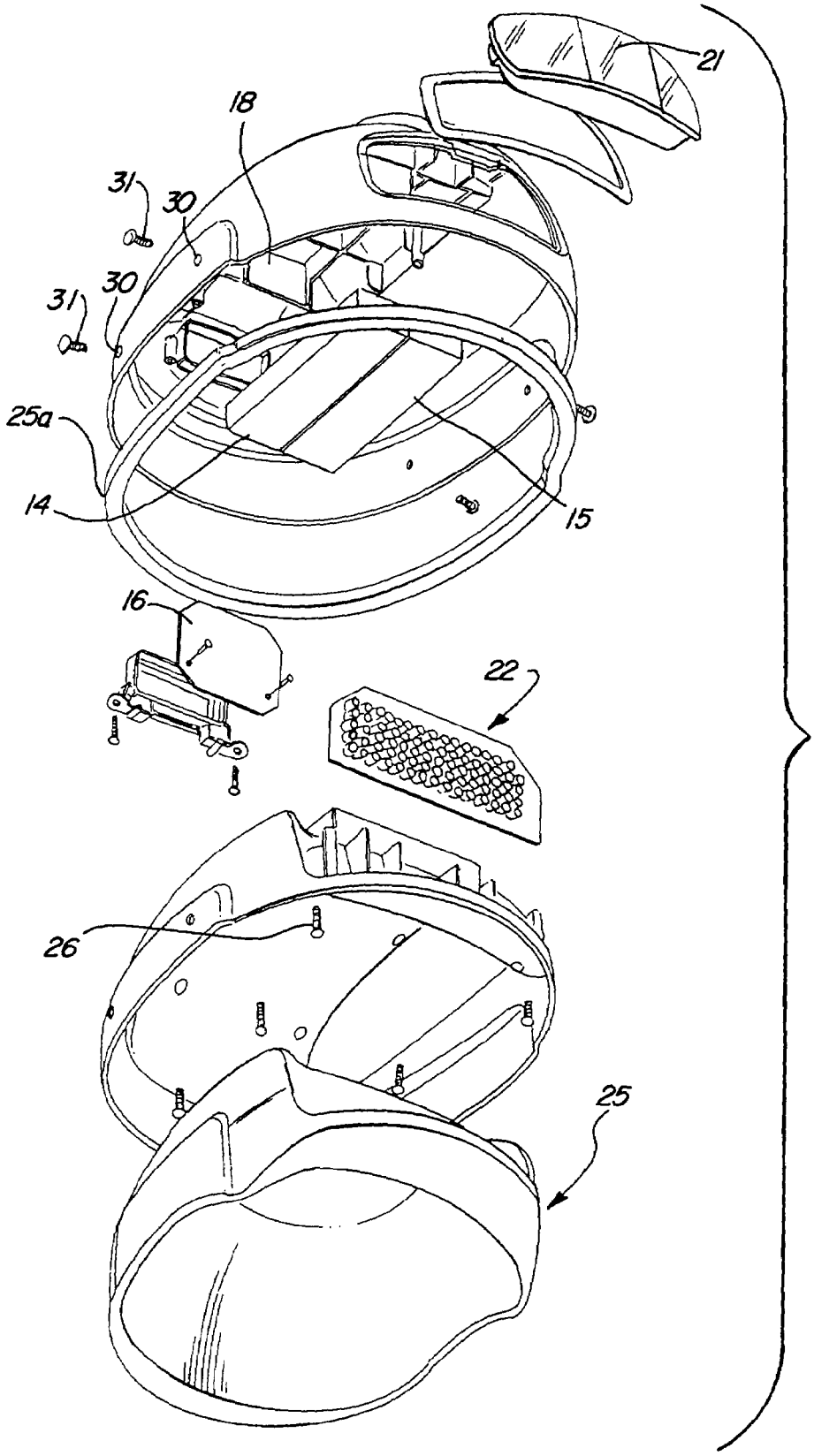
FIG. 2 is an exploded view of the upper and lower headgear components of the invention and the LED array.

The headgear 10 of this invention is shown in FIGS. 1–3, and comprises an upper helmet portion 11 defining an integrally formed, outer central reinforcing ridge 12 and a corresponding interior reinforcing grid area 13. Into the grid area 13 are mounted removable or rechargeable lithium ion battery packs 14 and 15 which connect to a circuit board 16, the circuit itself being shown in FIG. 4. Wire connections from the batteries to the circuit board and to the LED arrays are shown in FIG. 5.

A rearwardly installed LED array 17 is mounted on the upper helmet portion 11 and are connected to the circuit board and driven by the battery packs. The LED array 17 is shielded by a transparent acrylic sheet 18 mounted on the exterior of the upper helmet 11. The front area of the upper helmet 11 is provided with an enclosure 20 shielded by a curved, transparent acrylic sheet 21 which protects an enclosed, front facing LED array 22.

An interfitting helmet portion 25 is configured to interlock with the upper helmet portion 11, the two helmet portions being secured together vertically by screws 26. The helmet portion 25 defines a flat portion 27 which registers with grid area 13 and contacts the lower sides of the battery packs 14, 15 thereby securing the battery packs in place. As indicated, the front area of the helmet 25 defines the enclosure 20 into which the front facing LED array 22 is mounted.

Figure 4:
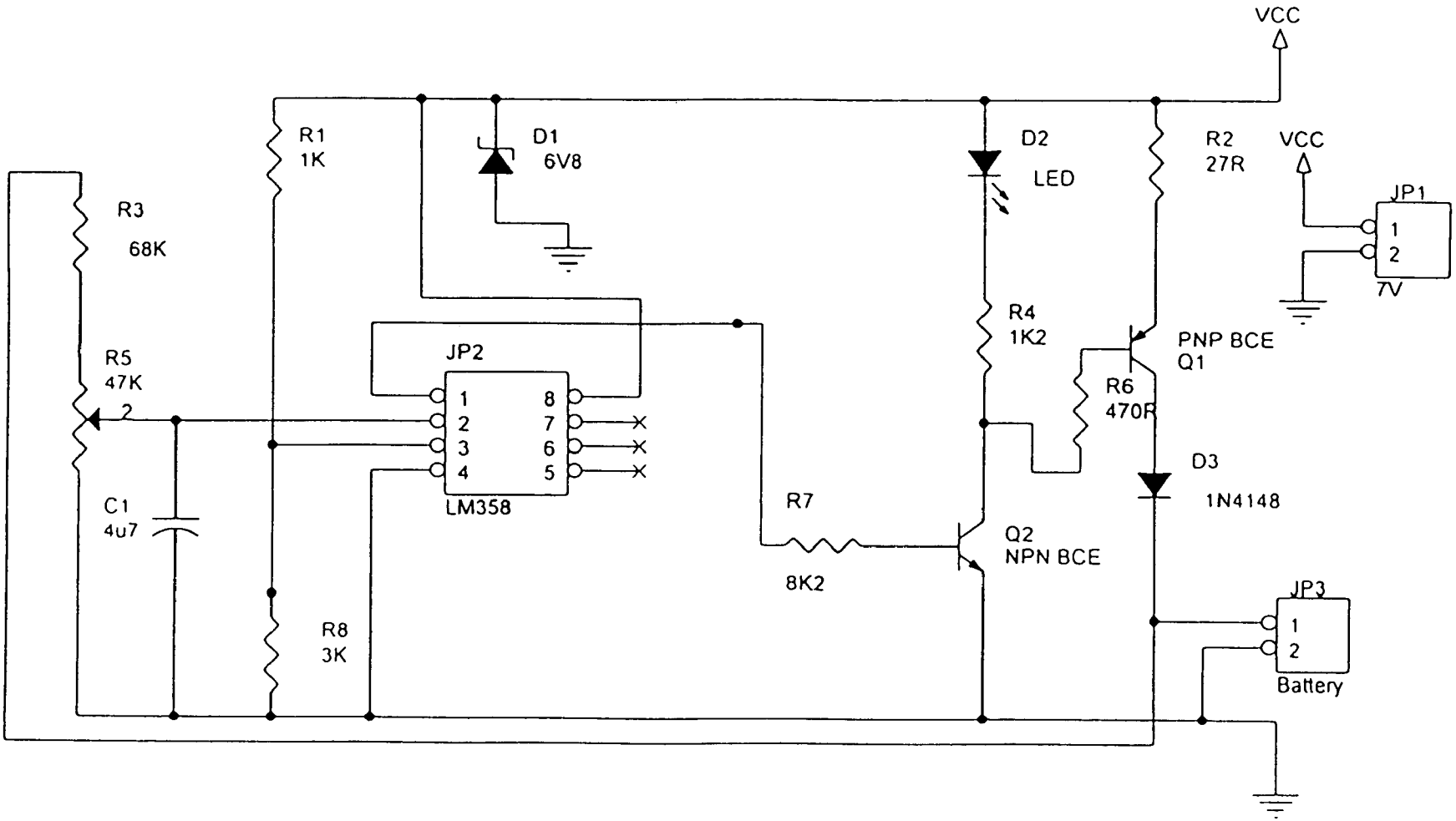
FIG. 4 is a circuit diagram of this invention for feeding power from the rechargeable batteries to the LED array; and, FIG. 5 shows the LED array connected to the rechargeable batteries.
Figure 5:
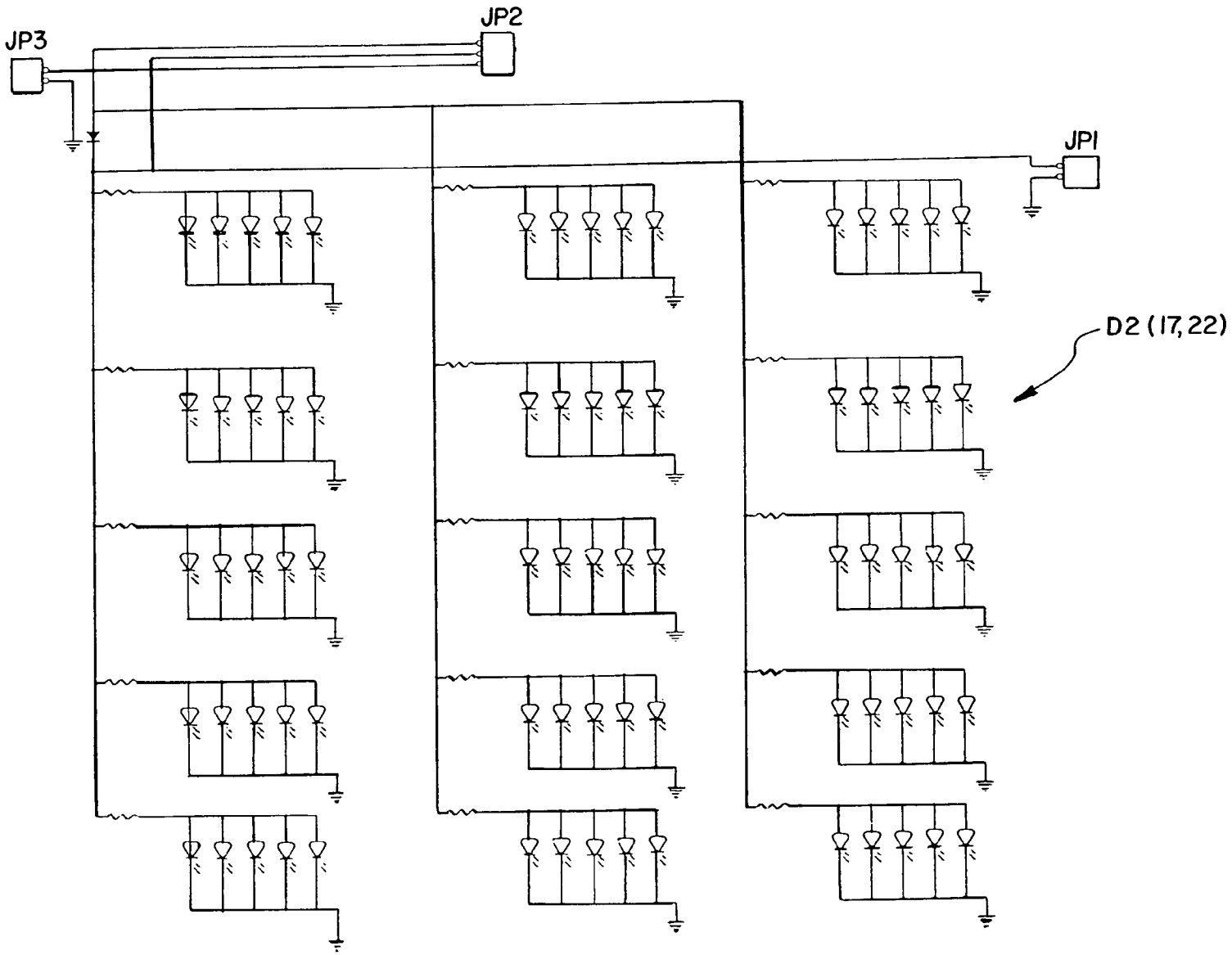

The LED array 22 is driven through the circuit board 16 from the battery packs 14 and 15 as shown in FIG. 4, similarly to the LED array 17 and the circuit of FIG. 4, which will be described, infra. FIGS. 3–5 show an on-off switch 28 connected to the circuit board 16 and circuit of this invention. FIG. 3 also shows a charging outlet pin 29 for the battery packs 14 and 15, the charging pin being adjacent to the on-off switch 28. The batteries also may be removed for recharging or replacement.

An integrally formed, reinforcing wrap-around section 11*a* on the helmet portion 11 defines bores 30 coinciding with bores (not shown) in the helmet portion 25 through which pass screws 31 which horizontally secure the helmet portions 11 and 25 together. The screws 26 and 31 thereby secure the helmet portions 11 and 25 both vertically and horizontally. If desired, an edge liner 25*a* of injection molded polypropylene may be employed to engage the edges between the helmet portions 11 and 25, and thereby effect additional securement between the two helmets.

As shown in FIG. 3, a protective foam head enclosure 32 such as constructed from polyurethane or polystyrene foam is provided to cushion the wearer's head from impact against the much harder ABS plastic materials of both the helmet portions 11 and 25. Similar bores (not shown) in the head enclosure 32 register with the bores 30 and enable the helmet portions 11 and 25 and the head enclosure to be secured together using the screws 31.

The circuit shown in FIGS. 4 and 5 enables a relatively long and uniform battery power output before charging is required. The lithium ion batteries JP1 and JP3 shown in FIGS. 4 and 5 each deliver about 6600 milliamps at 7.2 volts and are isolated from each other by a diode D3. When the on-off switch 28 (FIG. 3) is turned on at JP1, the batteries JP1 and JP3 will turn on a comparator such as an op amp comparator JP2, e.g. an LM358.

The comparator JP2 shows a direct coupled amplifier configuration driven from the battery JP1 through transistors PNP Q1 and NPN Q2, and through the coupling resistance R7 to the input pin 1 of JP2. Resistances R1, R2, R3, R6/R4 respectively will protect a Zener D1, Q1, R5-JP2 and LED arrays D2 (17, 22) from excessive current/voltage.

Battery power from JP3 is applied to the voltage divider R5 and then to pin 2 of JP2, while pins 3, 4 of JP2 are both at ground. Obviously, the op amp comparator JP2 is driven by both batteries JP1 and JP3. Capacitor C1 and resistance R8 are both grounded, and provide ripple filtering, and R8 also shunts voltage from pin 3 of the JP2 to the Zener D1. JP2 (at pin 8) also drives the Zener which functions as a shunt to maintain the load voltage constant for changing current/voltage variations due to running down of the batteries. In the reverse conduction condition as shown, the Zener D1 also reduces ripple voltage.

When the switch 28 (FIG. 3) is turned on at JP1, and voltage from the voltage divider R5 exceeds the pin 3 reference voltage, the comparator JP2 (LM358) will turn on, and hence transistors Q1 and Q2 (driven from JP1 and JP3) will then turn on the LED arrays D2 (17, 22).

Typically, the lumen output of the present device for about 93 LEDs is about 4000 MCD @ 20 milliamps for 5–5½ hours using 7.2 volt batteries. Moreover, the device of this invention frees up the wearer's hands when viewing an operating field, especially in an emergency situation.

It will be appreciated that while a Zener diode is preferred for use in the circuit described, other semiconductor devices with similar turn-on characteristics may be utilized, and they are described in the "SCR MANUAL, INCLUDING TRIACS AND OTHER THYRISTORS" Sixth Edition, 1979 by General Electric, and incorporated herein, by reference.

Additionally, the circuit of this invention may be employed for illuminating purposes other than in a helmet, such as an LED array in a flashlight; to function as a traffic signal; as an LED turn on device used with an alarm detection system; and so forth.

The invention claimed is:

1. A protective helmet providing at least one illuminating LED array, including a circuit driven by at least one battery for powering amplifying means to drive the array, the circuit comprising: a comparator, the battery providing an input voltage and a reference voltage for the comparator, the comparator being turned on when the input voltage exceeds the reference voltage, a semiconductor device actuated by the comparator, and functioning as a shunt to maintain a load voltage constant for voltage/current variations as the battery is worn down, and amplifiers connected to the battery, semiconductor device and comparator for turning on the LED array.

2. The helmet of claim 1, in which the comparator is an operational amplifier, the semiconductor device is a Zener diode, and the amplifiers are transistors.

3. The helmet of claim 2, in which input voltage is supplied to the comparator through a voltage divider.

4. The helmet of claim 2, in which batteries provide about 6600 milliamps @ 7.2 volts, and the LED array provides about 4000 MCD @ about 20 milliamps for about 6–5½ hours for about 93 LEDs in the arrays.

5. The helmet of claim 2, in which the Zener diode is operated in the reverse conduction condition to reduce ripple voltage.

6. The helmet of claim 2, comprising an inner component of resilient material, and central and outer components of a hard material, the components being secured together, and at least one LED array mounted in at least one of the central and outer components.

7. The helmet of claim 6, in which the resilient material is constructed as a foam.

8. The helmet of claim 6, in which the central and outer components are integrally formed of plastic material, at least one of the said components providing a centrally disposed reinforcing grid, and one or more batteries being secured in the reinforcing grid when the central and outer components are joined together.

9. The helmet of claim 2, in which components of the circuit are mounted on a circuit board secured by the helmet, and two batteries are employed for respective input and reference voltages, the batteries being isolated from each other by a diode.

10. The helmet of claim 1, the batteries being removable, rechargeable, or both.

* * * * *